US008201917B2

(12) United States Patent
Ito

(10) Patent No.: US 8,201,917 B2
(45) Date of Patent: Jun. 19, 2012

(54) INKJET RECORDING APPARATUS AND METHOD FOR CONTROLLING AN INKJET RECORDING APPARATUS

(75) Inventor: Yuichi Ito, Mie-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 548 days.

(21) Appl. No.: 12/345,600

(22) Filed: Dec. 29, 2008

(65) Prior Publication Data

US 2009/0167815 A1 Jul. 2, 2009

(30) Foreign Application Priority Data

Dec. 28, 2007 (JP) ..... 2007-338958

(51) Int. Cl.
*B41J 2/165* (2006.01)
*B41J 29/38* (2006.01)
*B41J 2/045* (2006.01)

(52) U.S. Cl. ..... 347/32; 347/5; 347/9; 347/10; 347/11; 347/20; 347/22; 347/29; 347/54; 347/68; 347/70; 347/71

(58) Field of Classification Search ..... 347/11, 347/32, 71
See application file for complete search history.

(56) References Cited

U.S. PATENT DOCUMENTS

2004/0155915 A1* 8/2004 Kitami et al. ..... 347/10
2007/0139453 A1* 6/2007 Sekiguchi ..... 347/11
2007/0139487 A1* 6/2007 Sekiguchi ..... 347/70
2007/0200885 A1 8/2007 Hibi
2007/0211092 A1* 9/2007 Shingyohuchi et al. ..... 347/10
2008/0123117 A1* 5/2008 Kimura et al. ..... 358/1.8
2008/0129772 A1* 6/2008 Kim et al. ..... 347/14

FOREIGN PATENT DOCUMENTS

JP 2003-039701 A 2/2003
JP 2005-104107 A 4/2005
JP 2007-253618 A 10/2007

OTHER PUBLICATIONS

Japan Patent Office, Notice of Reasons for Rejection for Japanese Patent Application No. 2007-338958 (counterpart to above-captioned patent application), mailed Jan. 24, 2012.

* cited by examiner

*Primary Examiner* — Ryan Lepisto
(74) *Attorney, Agent, or Firm* — Baker Botts L.L.P.

(57) ABSTRACT

An inkjet recording apparatus may include a flow path unit including a discharge port, an actuator configured to supply discharge energy and non-discharge energy to the ink, a drive controller configured to cause the actuator to supply the discharge energy, and a cap moving unit configured to move a cap between the open position and the covering position. After the supply of the image data is started, the drive controller may cause the actuator to supply the non-discharge energy in both a first period and a second period. The first period begins at starting of the supply of the non-discharge energy. The second period begins at the end of the first period and ends when the supply of the discharge energy is started. A frequency of the supply of the non-discharge energy during the first period is greater than that of the non-discharge energy during the second period.

15 Claims, 12 Drawing Sheets

INKJET RECORDING APPARATUS AND METHOD FOR CONTROLLING AN INKJET RECORDING APPARATUS

CROSS REFERENCE TO RELATED APPLICATION

This application claims priority to Japanese Patent Application No. 2007-338958, filed Dec. 28, 2007, the entire subject matter and disclosure of which is incorporated by reference.

BACKGROUND OF THE DISCLOSURE

1. Field of the Disclosure

The features herein relate to an inkjet recording apparatus that records an image onto a recording medium and a method for controlling an inkjet recording apparatus that records an image onto a recording medium.

2. Description of the Related Art

In a known inkjet recording apparatus, ink near a discharge port, which discharges ink, is protected from drying by capping the discharge port. However, when the discharge port is capped for a long time, ink viscosity near the discharge port is increased. When this state continues, the ink may not be properly discharged from the discharge port.

Ink is agitated by very slightly vibrating a meniscus of the ink so as not to discharge the ink. The ink is very slightly vibrated until printing is started after a cap is removed from a recording head.

However, in a case where a period in which the ink is very slightly vibrated is not changed, when the period of vibration is short (the vibration frequency is high), energy used for very slightly vibrating the ink may be wastefully consumed. When the period of vibration is long (the vibration frequency is low), the ink viscosity may not be sufficiently reduced.

SUMMARY OF THE INVENTION

A need has arisen for an inkjet recording apparatus that may restrict a reduction in image quality while restricting consumption of energy for very slightly vibrating ink.

According to one embodiment herein, an inkjet recording apparatus that forms an image corresponding to an image data on a recording medium may include a flow path unit including a discharge port that is configured to discharge ink and an ink flow path that is configured to supply the ink to the discharge port. The inkjet recording apparatus may also include an actuator that is configured to supply discharge energy to the ink in the ink flow path to be discharged from the discharge port and non-discharge energy to the ink in the ink flow path, wherein the non-discharge energy is adjusted not to discharge the ink from the discharge port. The inkjet recording apparatus may also include a drive controller that is configured to cause the actuator to supply the discharge energy to the ink to discharge the ink onto the recording medium. The inkjet recording apparatus may also include a cap that is configured to move between a covering position and an open position, wherein when the cap is at the covering position, the cap covers the discharge port, and wherein when the cap is at the open position, the discharge port is uncovered. The inkjet recording apparatus may also include a cap moving unit that is configured to move the cap between the open position and the covering position. After the supply of the image data is started, the drive controller may cause the actuator to supply the non-discharge energy to the ink in both a first period and a second period, wherein the first period begins at starting of the supply of the non-discharge energy, and the second period begins at the end of the first period and ends when the supply of the discharge energy is started, wherein a frequency of the supply of the non-discharge energy during the first period is greater than the frequency of the supply of the non-discharge energy during the second period.

According to another embodiment herein, a method for controlling an inkjet recording apparatus may include the step of supplying an image data for forming an image onto a recording medium. The method may also include the step of supplying non-discharge energy to ink in an ink flow path in a first period, wherein the non-discharge energy is adjusted not to discharge the ink from the discharge port, and wherein the first period begins at starting of the supply of the non-discharge energy. The method may also include the step of supplying non-discharge energy to the ink in the ink flow path in a second period, and wherein the second period begins at the end of the first period. The method may also include the step of supplying discharge energy to the ink in the ink flow path to be discharged from a discharge port to the actuator when the second period ends. A frequency of the supply of the non-discharge energy during the first period may be greater than the frequency of the supply of the non-discharge energy during the second period.

Other objects, features and advantages will be apparent to those skilled in the art from the following detailed description and accompanying drawings.

BRIEF DESCRIPTION OF THE DRAWINGS

Embodiments of an inkjet recording apparatus and a method for controlling an inkjet recording apparatus are described with reference to the accompanying drawings, which are given by way of example only, and are not intended to limit the present patent.

DESCRIPTION OF THE EMBODIMENTS

Various embodiments, and their features and advantages, may be understood by referring to FIGS. 1-12, like numerals being used for corresponding parts in the various drawings.

Figure 1:
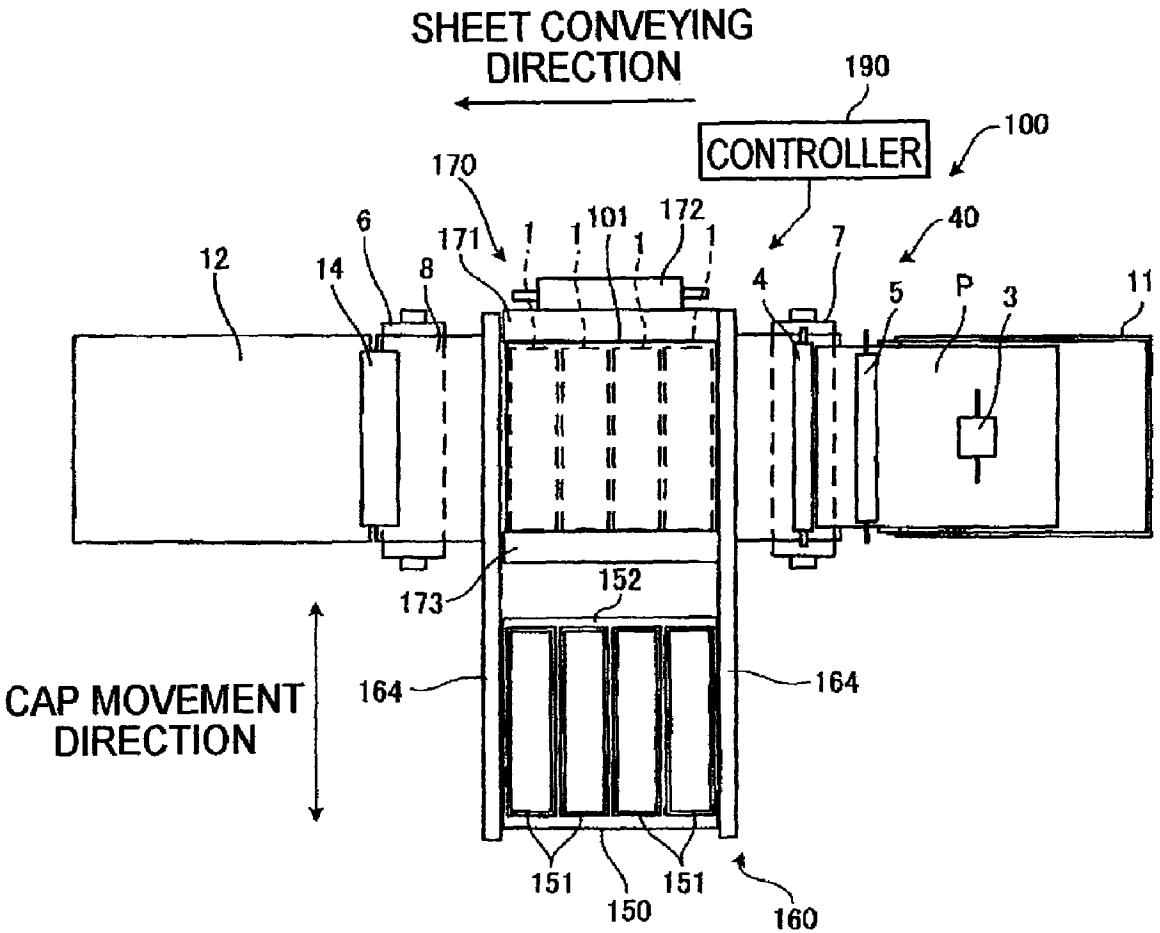
FIG. 1 is a schematic plan view of an inkjet printer according to an embodiment.
Figure 2:
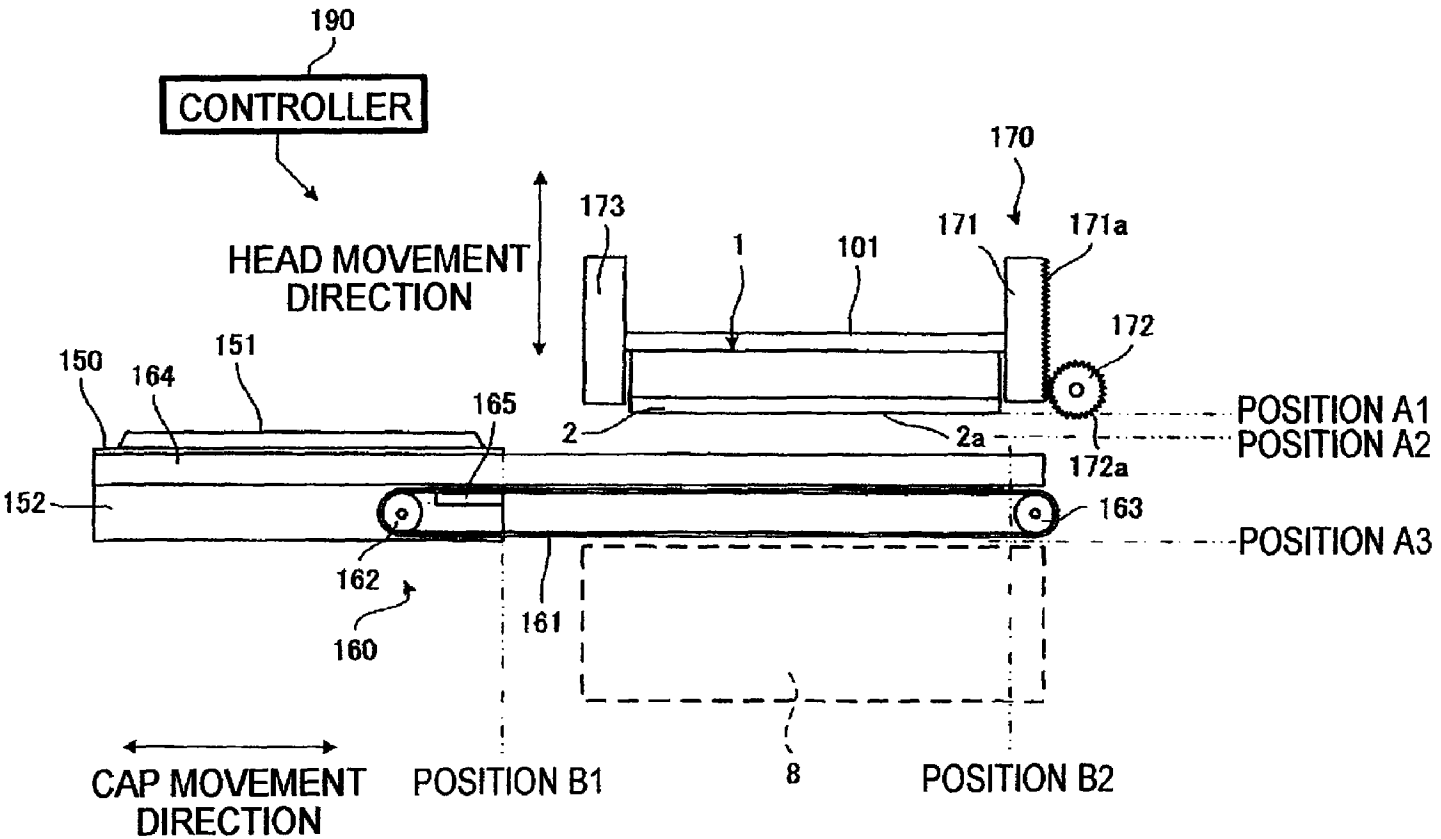
FIG. 2 is a side view of a head unit and a cap unit.

Referring to FIGS. 1 and 2, an inkjet printer 100 may be a color inkjet printer comprising a plurality of, e.g., four, inkjet heads 1. The inkjet printer 100 may include a controller 190 that controls each section. Further, the inkjet printer 100 may include a sheet feeder 11 on the right side in FIG. 1 and a sheet discharger 12 on the left side in FIG. 1.

A sheet conveying mechanism 40 that conveys a sheet, i.e., recording medium, P towards the sheet discharger 12 from the sheet feeder 11 may be positioned in the internal portion of the inkjet printer 100. The sheet conveying mechanism 40 may include feed rollers 3 and 5, belt rollers 6 and 7, and a conveying belt 8. The feed roller 3 may be provided at the sheet feeder 11, and may sequentially send sheets P contained in the sheet feeder 11 towards the left in FIG. 1. The feed roller 5 may be positioned immediately downstream from the sheet feeder 11. The feed roller 5 may include a pair of rollers opposing each other in a perpendicular direction. These rollers may extend orthogonally and horizontally with respect to a sheet conveying direction, and may send the sheets P towards the left in FIG. 1 from the sheet feeder 11 while nipping the sheets P conveyed from the sheet feeder 11. The plurality of, e.g., two, belt rollers 6 and 7 and the endless conveying belt 8, wound upon the rollers 6 and 7, may be positioned downstream from the feed roller 5. A platen is positioned opposing the inkjet head 1 with the conveying belt 8 being positioned therebetween. The platen may support the conveying belt 8 so that the conveying belt 8 is not flexed downward. A nip roller 4 may be positioned above the belt roller 7. The nip roller 4 may push the sheet P that has been sent out by the feed roller 5 from the sheet feeder 11 against the outer peripheral surface of the conveying belt 8.

The conveying belt 8 may be moved by rotating the belt roller 6 by a conveyance motor. This may cause the conveying belt 8 to convey the sheet P pushed against the outer peripheral surface of the conveying belt 8 by the nip roller 4 towards the sheet discharger 12 while the sheet P is adhered to and held by the conveying belt 8. The surface of the conveying belt 8 may be formed of a silicon resin layer having low adhesion.

A separating mechanism 14 may be positioned immediately downstream from the conveying belt 8. The separating mechanism 14 may be configured so as to separate the sheet P adhered to the outer peripheral surface of the conveying belt 8 from the outer peripheral surface of the conveying belt 8, and so as to introduce the sheet P towards the sheet discharger 12 on the left side in FIG. 1.

The inkjet printer 100 may include a head unit 101 in which the plurality of inkjet heads 1 are disposed in the sheet conveying direction. Each inkjet head 1 may schematically have a rectangular parallelepiped shape, and have a long rectangular flat shape in a direction orthogonal to the sheet conveying direction. The plurality of inkjet heads 1 may be secured to the head unit 101 in correspondence with a plurality of, e.g., four, colors of ink (e.g., magenta, yellow, cyan, and black).

Each inkjet head 1 may include a head body 2 at its lower end. Each head body 2 may have a long elongated rectangular parallelepiped shape in the direction orthogonal to the conveying direction. An ink discharge surface 2*a*, where nozzles 108 open, may be positioned in the lower surface of each head body 2. The ink discharge surfaces 2*a* may also extend horizontally, and may be positioned at corresponding locations in a vertical direction. When a sheet P that is conveyed by the conveying belt 8 sequentially passes immediately below the plurality of head bodies 2, ink drops of the corresponding colors may be discharged from the ink discharge surfaces 2*a* towards the top surface, that is, a print surface, i.e., print area, of the sheet P. This makes it possible to form a predetermined color image on the print area of the sheet P.

The head unit 101 may be positioned inside the inkjet printer 100 so as to be made vertically movable by a head moving mechanism 170. The head moving mechanism 170 may include supporting members 171 and 173 that support both the left and right sides of the head unit 101 in FIG. 2. The supporting member 171 may have an engaging section 171*a* in which a plurality of teeth are disposed like sawteeth in the vertical direction. The head moving mechanism 170 may also include a gear 172 having the form of a disc. An engaging section 172*a* provided with a plurality of teeth that are disposed in the circumferential direction may be positioned at the circumference of the gear 172. The gear 172 may be positioned inside the inkjet printer 100 so as to be rotatable around a rotational axis passing through the center of its disc form. The engaging section 171*a* of the supporting member 171 and the engaging section 172*a* of the gear 172 may engage each other. The head moving mechanism 170 may include a driving motor that rotates the gear 172. Rotating the gear 172 in the forward direction and the reverse direction may cause reciprocating the supporting member 171 vertically. Therefore, the head unit 101 may vertically reciprocate in an up-down direction.

The inkjet printer 100 may also include a cap unit 150 that protects the ink discharge surfaces 2*a* of the inkjet heads 1. The cap unit 150 may include a moving table 152 and the plurality of, e.g., four, cap bodies 151 secured to the upper surface of the moving table 152. The upper surface of the moving table 152 may extend horizontally. The cap bodies 151 may be positioned on the moving table 152 in the sheet conveying direction. Each cap body 151 may have an annular protruding portion that protrudes upward from the upper surface of the moving table 152. In plan view with respect to a direction orthogonal to the sheet conveying direction in plan view, each protruding portion may extend along a long rectangular outer periphery, and the upper end surface of each protruding portion may extend horizontally. In plan view, the protruding portion of each cap body 151 may have a flat shape that may include in its interior an area where the openings of the nozzles 108 are formed at the discharge surfaces 2*a* of each inkjet head 1.

A cap moving mechanism 160 that moves the cap unit 150 may be positioned inside the inkjet printer 100. The cap moving mechanism 160 may include a guide member 164 that movably supports the cap unit 150. The guide member 164 may extend in a straight line in a cap movement direction that is orthogonal to the sheet conveying direction and that is parallel to the horizontal direction. The guide member 164 may movably support both sides of the cap unit 150 in the sheet conveying direction. The cap moving mechanism 160 may also include a moving belt 161 and rollers 162 and 163. The rollers 162 and 163 may be positioned at corresponding locations in the sheet conveying direction and the vertical direction, and may be separated from each other in the cap movement direction. The moving belt 161 may be an endless belt, and may be wound upon the rollers 162 and 163. The cap moving mechanism 160 may include a driving motor that rotates the roller 162. Rotating the roller 162 by the driving motor may cause the moving belt 161 to rotate clockwise and counterclockwise in FIG. 2. A securing member 165 may be positioned at a side wall of the cap unit 150, and may connect the cap unit 150 and the moving belt 161 to each other. Therefore, the cap moving mechanism 160 may reciprocate the cap unit 150 in the cap movement direction by moving the moving belt 161.

The ranges in which the head moving mechanism 170 and the cap moving mechanism 160 move the head unit 101 and the cap unit 150, respectively, may be as follows. First, the head moving mechanism 170 moves the head unit 101 between positions A1 and A2 and A3 shown in FIG. 2. The position A1 corresponds to a position where the ink discharge surfaces 2*a* are positioned above the upper end surfaces of the cap bodies 151. The position A2 corresponds to a position where the ink discharge surfaces 2*a* are positioned at the same height as the upper end surfaces of the cap bodies 151 in the up-down direction. The position A3 corresponds to an ink discharge position where ink is discharged towards a sheet from each inkjet head 1 and where the ink discharge surfaces 2*a* come close to the conveying belt 8 so as to be separated by a predetermined discharge distance.

The cap moving mechanism 160 moves the cap unit 150 between positions B1 and B2 where the right end of the cap unit 150 in FIG. 2 is positioned. The position B1 corresponds to a position where the cap unit 150 is completely withdrawn towards the left from the head unit 101. In plan view, the position B2 corresponds to a position that allows the cap bodies 151 to include in their interiors, the area where the openings of the nozzles 108 are formed at the inkjet discharge surfaces 2*a* of the inkjet heads 1.

Figure 3:
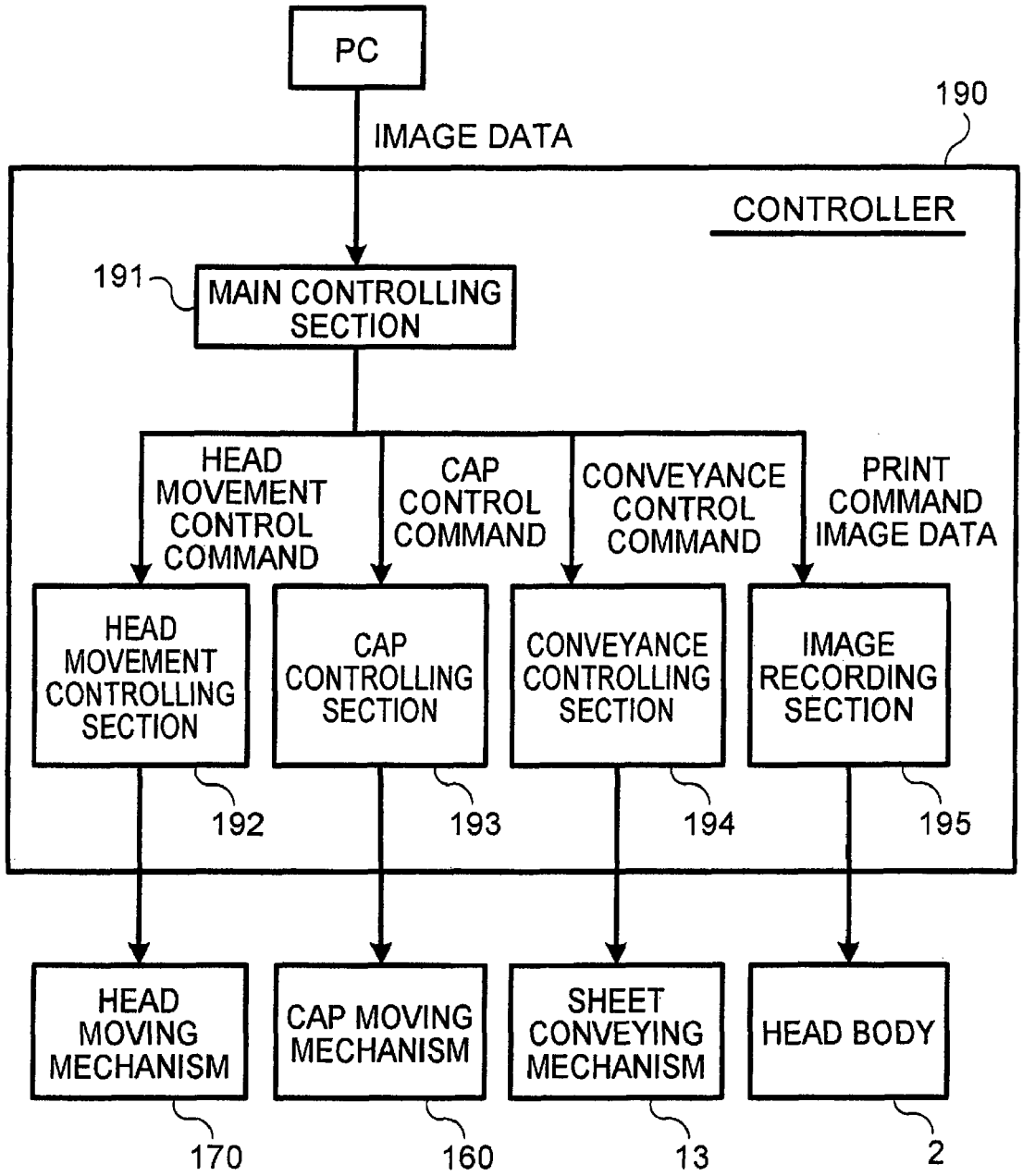
FIG. 3 is a block diagram of the structure of a controller.

Referring to FIG. 3, the controller 190 may be configured of various electronic components, processor circuits, hardware, e.g., a storage device, and software, e.g., a program, that causes the hardware to function as various functional blocks shown in FIG. 3. The controller 190 may include a main controlling section 191 that controls the entire control contents regarding the inkjet printer 100. The controller 190 may also include a head movement controlling section 192, a cap controlling section 193, a conveyance controlling section 194, and an image recording section 195, which control the respective mechanisms, such as the head moving mechanism 170. The main controlling section 191 may transmit control commands to these controlling sections. The head movement controlling section 192 and the other sections 193 to 195 may control the movements of their respective mechanisms, such as the head moving mechanism 170, on the basis of the respective control commands from the main controlling section 191.

The operations of the inkjet printer 100 that are realized as a result of the controlling operation of the controller 190 will be schematically described. A first operation may correspond to a cap covering operation in which the cap bodies 151 cover the ink discharge surfaces 2*a* of the respective inkjet heads 1. The cap covering operation may be carried out when discharge characteristics of the inkjet heads 1 are recovered, or when an image is not formed even when image formation processing is completed or even when a predetermined time passes after the image formation processing is completed, or when a main power supply of the inkjet printer 100 is turned off. First, the position of the cap unit 150 in the state shown in FIG. 2 corresponds to an open position of the cap unit 150. Next, the head movement controlling section 192 may cause the head moving mechanism 170 to move the head unit 101 to the position A1, so that the cap unit 150 may move below the head unit 101. Next, the cap controlling section 193 may cause the cap moving mechanism 160 to move the cap unit 150 to the position B2. Then, the head movement controlling section 192 may cause the head moving mechanism 170 to move the head unit 101 to the position A2. As mentioned above, the position A2 may correspond to the position where the ink discharge surfaces 2*a* are disposed at the same height as the upper end surfaces of the cap bodies 151. Therefore, the upper end surfaces of the cap bodies 151 may contact the ink discharge surfaces 2*a*. Then, the cap unit 150 may cover the openings of the nozzles 108 formed in the ink discharge surfaces 2*a*. The position of the cap unit 150 at this time may correspond to a covering position.

A second operation may correspond to a cap separation operation in which the cap unit 150 is separated from the ink discharge surfaces 1*a*. The cap separation operation may be carried out when recovery of the discharge characteristics is completed or when formation of an image is started again while waiting for image formation processing. In this operation, the controlling operations may be carried out in an order that is the reverse of that mentioned above. That is, while the cap unit 150 is at the covering position, the head unit 101 may be moved to the position A1. Then, the cap unit 150 may be moved to the position B1.

A third operation may correspond to a printing operation in which an image is formed on a sheet P. When image data is transmitted from, for example, an external personal computer (PC), the main controlling section 191 may determine whether the cap unit 150 is at the covering position or at an open position. When the main controlling section 191 determines that the cap unit 150 is at the covering position, the main controlling section 191 may transmit a control command for commanding execution of the cap separation operation, to the head movement controlling section 192 and the cap controlling section 193. When the head movement controlling section 192 and the cap controlling section 193 receive the control command, they may execute the cap separation operation.

Then, the main controlling section 191 may transmit a head movement control command to the head movement controlling section 192. This control command may be transmitted for commanding movement of the head unit 101 to a printing position. When the head movement controlling section 192 receives the command control, it may control the head moving mechanism 170 to move the head unit 101 to the printing position A3. In contrast, when the main controlling section 191 determines that the cap unit 150 is at the open position, it may confirm the position of each inkjet head 1. When the main controlling section 191 determines that each inkjet head 1 is at the position A3, it may execute the next processing. However, when the main controlling section 191 determines that each inkjet head 1 is at a position other than the position A3, as mentioned above, it may control the head movement controlling section 192 to move the head unit 101 to the printing position A3, after which it executes the next processing.

Then, the main controlling section 191 may transmit a conveyance control command to the conveyance controlling section 194. The conveyance control command may be transmitted for commanding conveyance of a sheet P at a predetermined timing. At the same time, the main controlling section 191 may transmit a print command along with image data to the image recording section 195. The print command may be transmitted to command formation of an image right on a conveyed sheet P at a predetermined timing. The conveyance controlling section 194 that has received the conveyance control command may control sheet conveying mechanism 40 so that it conveys the sheet P at the predetermined timing. When the image recording section 195 receives the print command and the image data, it may control the head bodies 2, to form the image on the sheet P conveyed at the predetermined timing.

When images are formed onto a predetermined number of sheets P requested from, for example, a PC, the main controlling section 191 may transmit a control command to the head movement controlling section 192 and the cap controlling section 193, to execute the aforementioned cap covering operation. This may cause the cap unit 150 to protect the discharge surfaces 2*a* of the inkjet heads 1 even after the printing, so that, for example, the drying of ink at the ink discharge surfaces 2*a* is prevented from occurring.

Figure 4:
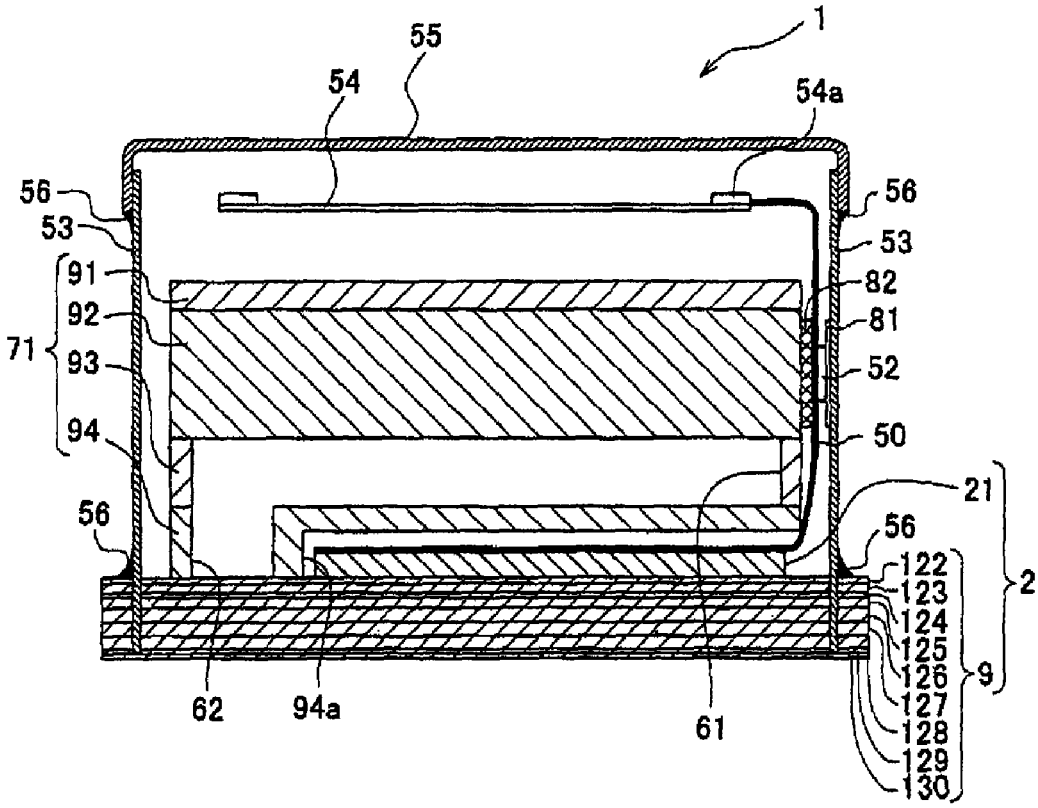
FIG. 4 is a sectional view taken along a short-side direction of an inkjet head.

Referring to FIG. 4, the inkjet head 1 may include a flow path member, an electrical member, and a cover member. The flow path member may include a flow path formed in its interior. The electrical member may discharge ink drops from the flow path member. The cover member may protect the electrical member. The flow path member may include a head body 2, including a flow path unit 9 and an actuator unit 21, and a reservoir unit 71, positioned above the head body 2. The reservoir unit 71 may temporarily store ink and may supply ink to the head body 2. The electrical member may include a Chip On Film (COF), to which a driver IC 52 is mounted, and a substrate 54 electrically connected to the COF 50. One end of the COF 50 may be connected to the actuator unit 21, so that a drive signal that is generated by the driver IC 52 is supplied to the actuator unit 21. The cover member may include a side cover 53 and a head cover 55. The cover member may accommodate the electrical member, and prevents entry of ink or ink mist from the outside.

The reservoir unit 71 may be configured by laminating a plurality of, e.g., four, plates 91 to 94 that are aligned with respect to each other. An ink flow-in path, an ink reservoir 61, and ten ink flow-out paths 62 may be formed inside of the reservoir unit 71 so as to be connected to each other.

A recess 94*a* opposing the flow path unit 9 may be formed in the plate 94. A gap may be formed between the flow path unit 9 and a portion where the recess 94*a* of the plate 94 is formed. The actuator unit 21 may be positioned in the gap. Ink that has flown into the ink reservoir 61 may flow through the ink flow-out paths 62, and may be supplied to the flow path unit 9 through ink supply openings 105*b*.

The vicinity of the one end of the COF 50 may be adhered to the upper surface of the actuator unit 21 so as to be electrically connected with a common electrode 134 and individual electrodes 135 and a common electrode 134. In addition, the COF 50 may be drawn out upward so as extend from the top surface of the actuator unit 21 to a location between the side cover 53 and the reservoir unit 71. The other end of the COF 50 may be connected to the substrate 54 through a connector 54*a*.

Figure 5:
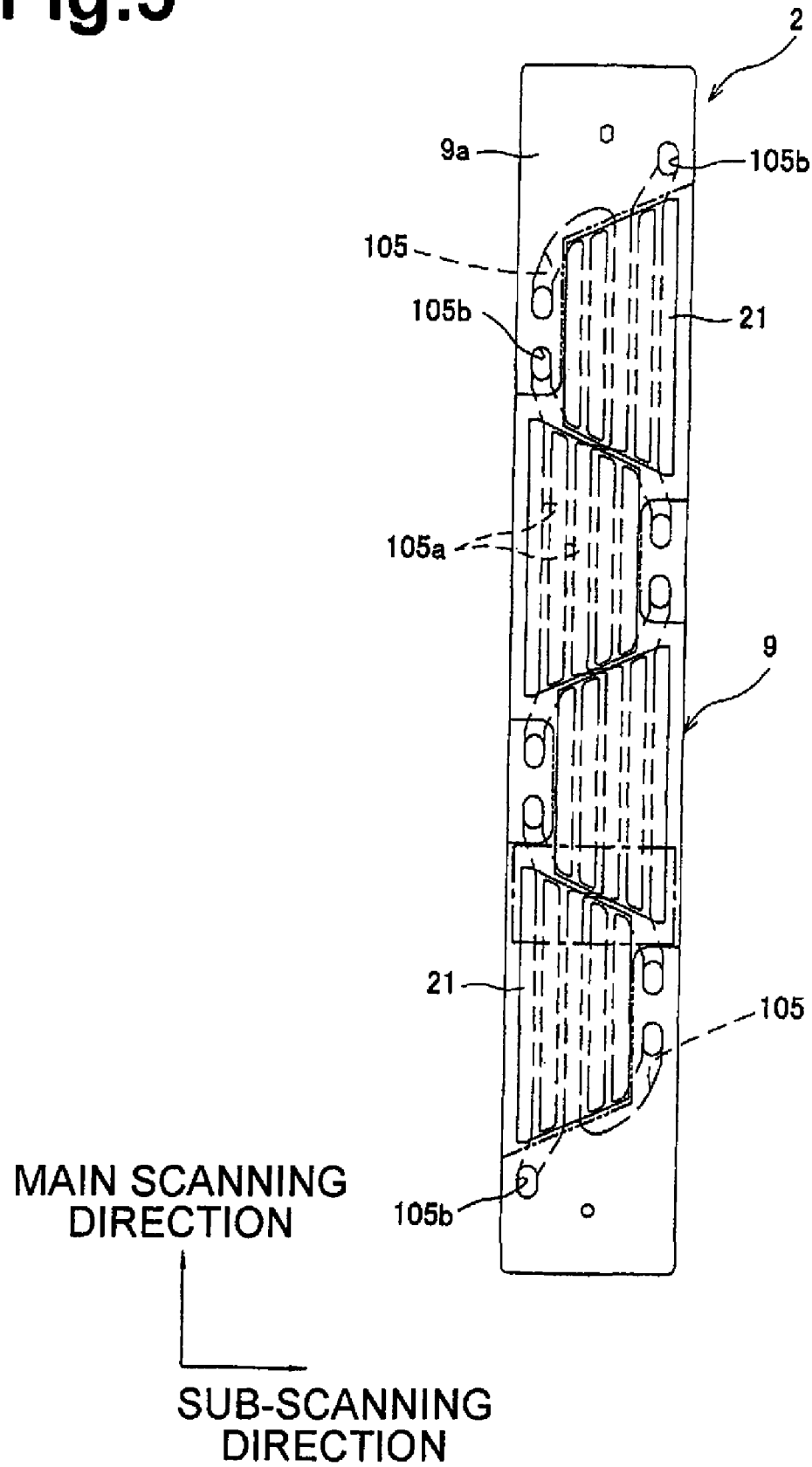
FIG. 5 is a plan view of a head body.
Figure 6:
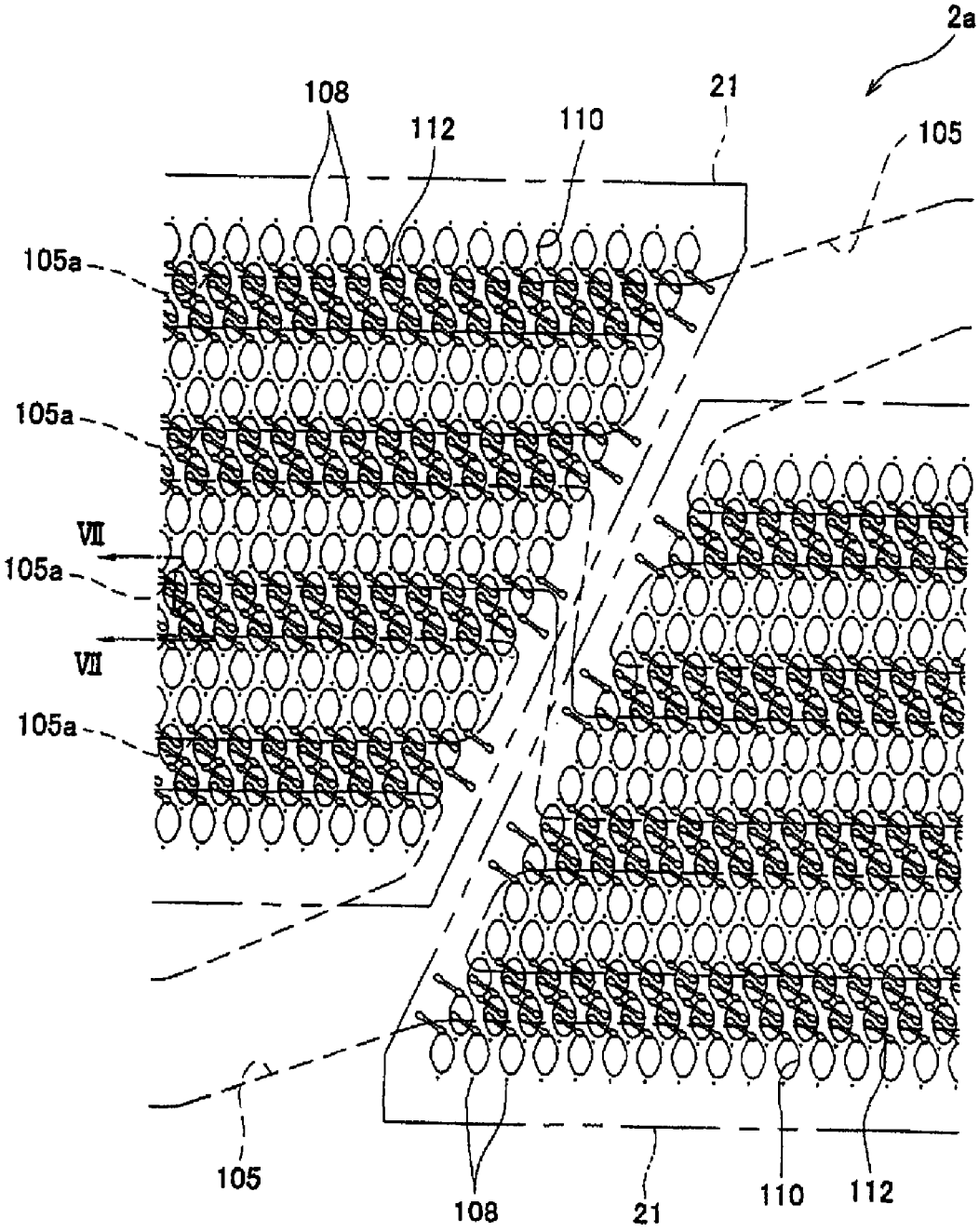
FIG. 6 is an enlarged view of an area surrounded by an alternate long and short dash line of FIG. 5.

Referring to FIG. 5, in the head body 2, a plurality of, e.g., four, actuator units 21 may be secured to an upper surface 9*a* of the fluid path unit 9. Referring to FIG. 6, each actuator unit 21 may include a plurality of actuators positioned to oppose the pressure chambers 110 formed in the fluid path unit 9, and may function to selectively apply discharge energy to ink in the pressure chambers 110. In FIG. 6, the pressure chambers 110, the apertures 112, and the nozzles 108, which are positioned below the actuator unit 21, are indicated by solid lines.

Figure 7:
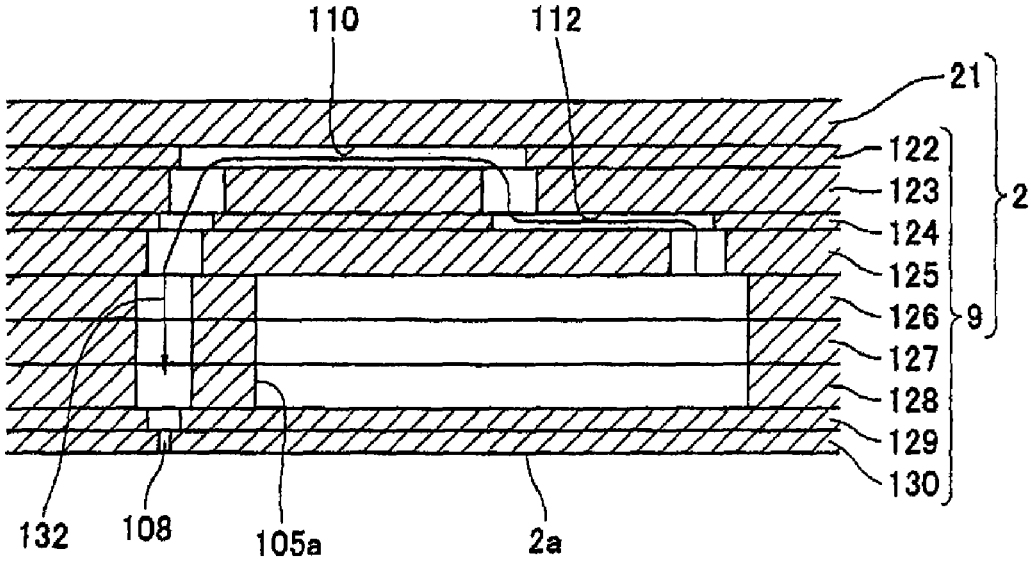
FIG. 7 is a partial sectional view taken along line VII-VII shown in FIG. 6.

The fluid path unit 9 may have a rectangular parallelepiped form having substantially the same planar shape as the plate 94 of the reservoir unit 71. A total of 10 ink supply openings 105*b* may be formed in the upper surface 91 of the flow path unit 9 in correspondence with the ink flow-out paths 62 (see FIG. 4) of the reservoir unit 71. Manifold flow paths 105 and sub-manifold flow paths 105*a* may be formed inside the flow path unit 9. The manifold flow paths 105 may be connected to the ink supply ports 105*b*. The sub-manifold flow paths 105*a* may branch from the manifold flow path 105. Referring to FIGS. 6 and 7, the ink discharge surfaces 2*a*, where many nozzles 108 are disposed in a matrix, may be formed in the lower surface of the flow path unit 9. In a securing plane of the actuator unit 21 at the flow path unit 9, a plurality of pressure chambers 110 may be also disposed in a matrix as with the nozzles 108.

Referring to FIG. 7, the flow path unit 9 may include a plurality of, e.g., nine, metallic plates 122 to 130 made of, for example, stainless steel. These plates 122 to 130 may have a long rectangular flat shape in a main scanning direction.

When these plates 122 to 130 are laminated upon each other while being aligned with respect to each other, through holes formed in the plates 122 to 130 may be connected to each other, so that many individual ink flow paths 132 are formed in the flow path unit 9 so as to extend from the manifold flow paths 105 to the sub-manifold flow paths 105*a*, and from the exits of the sub-manifold flow paths 105*a* to the nozzles 108 through the pressure chambers 110.

Ink supplied into the flow path unit 9 from the reservoir unit 71 may flow from the manifold flow path 105, i.e., sub-manifold flow paths 105*a*, into each of the individual ink flow paths 132, and may reach the nozzles 108 through the apertures 112 and the pressure chambers 110.

Referring back to FIG. 5, the plurality of, e.g., four, actuator units 21 may have trapezoidal flat shapes, respectively, and may be positioned in a staggered arrangement so as not to be positioned on the ink supply openings 105*b*. The opposite parallel sides of each actuator unit 21 may extend in the longitudinal direction of the flow path unit 9, and oblique sides of adjacent actuator units 21 may overlap each other in a widthwise (sub-scanning) direction.

Figure 8A:
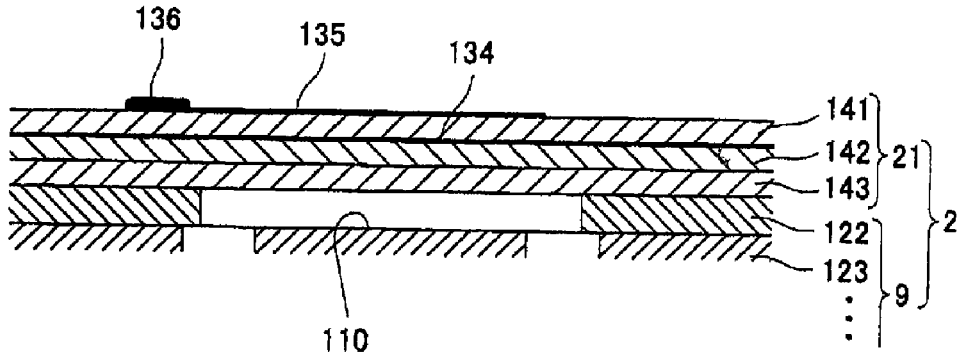
FIGS. 8A and 8B are each an enlarged view of an actuator unit.
Figure 8B:
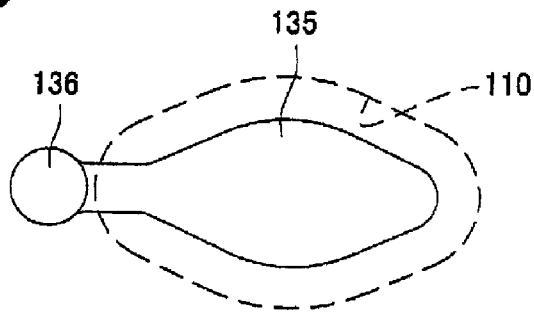

Referring to FIG. 8A, each actuator unit 21 may include a plurality of, e.g., three, piezoelectric sheets, i.e., piezoelectric layers, 141 to 143, made of ceramic material, such as PZT, having high dielectricity. The individual electrodes 135 may be positioned on the top surface of the piezoelectric sheet 141 opposing the pressure chambers 110. The common electrode, i.e., ground electrode, 134, positioned in the entire surface of the sheet, may be interposed between the topmost piezoelectric sheet 141 and the piezoelectric sheet 142 below it. Referring to FIG. 8B, the individual electrodes 135 each may have a substantially rhombic flat shape that is similar to the shape of the pressure chambers 110. One of acute-angle portions of the individual electrode 135 may be extended outward. An end of each extended portion may be provided with a circular conductive land 136.

A ground electrical potential, i.e., standard electrical potential, may be applied to the common electrode 134. The individual electrodes 135 may be electrically connected with an output circuit 52*a* (see FIG. 9), formed inside of the driver IC 52, through an internal wire of the COF 50 and each land 136. That is, in the actuator unit 21, a portion positioned between the individual electrodes 135 and the pressure chambers 110 functions as an individual actuator.

The method of driving each actuator unit 21 may be as follows. The piezoelectric sheet 141 may be positioned between a plurality of individual electrodes 135 and the common electrode 134, whereas the piezoelectric sheets 142 and 143 may be positioned between the common electrode 134 and the upper surface of the flow path unit 9. Here, the piezoelectric sheet 141, which is positioned between the individual electrodes 135 and the common electrode 134, may function as an active layer, and may expand or contract in a planar direction when a voltage is applied to a location between the electrodes. The portion functioning as the active layer may move in concert with the piezoelectric sheets 142 and 143 positioned at the pressure-chamber-110 side, and may be deformed so as to change the volume of the pressure chamber 110. If an electrical field direction and a polarization direction of the active layer corresponds to a thickness direction, the active layer may contract in the planar direction, so that portions corresponding to the individual electrodes 135 are deformed in a convex shape in the inward direction of the pressure chambers 110 (i.e., unimorph deformation). This may cause pressure to be applied to ink in the pressure chambers 110, so that a pressure wave is generated in the inside of the pressure chambers 110. The generated pressure wave may be transmitted from the pressure chamber 110 to the nozzles 108. Depending upon the size of the pressure wave, ink drops may be discharged from the nozzles 108. If the pressure wave is small, ink drops may be not discharged, so that a very small vibration occurs in a meniscus of the ink at the openings, i.e., discharge ports, of the nozzles 108. In the specification, energy that is applied to ink by the actuator units 21 and that causes ink drops to be discharged from the nozzles 108 may be called discharge energy. In contrast, energy that does not cause ink drops to be discharged from the nozzles 108 and that causes a very small vibration to occur in a meniscus of ink at the opening of the nozzles 108 may be called non-discharge energy.

Figure 9:
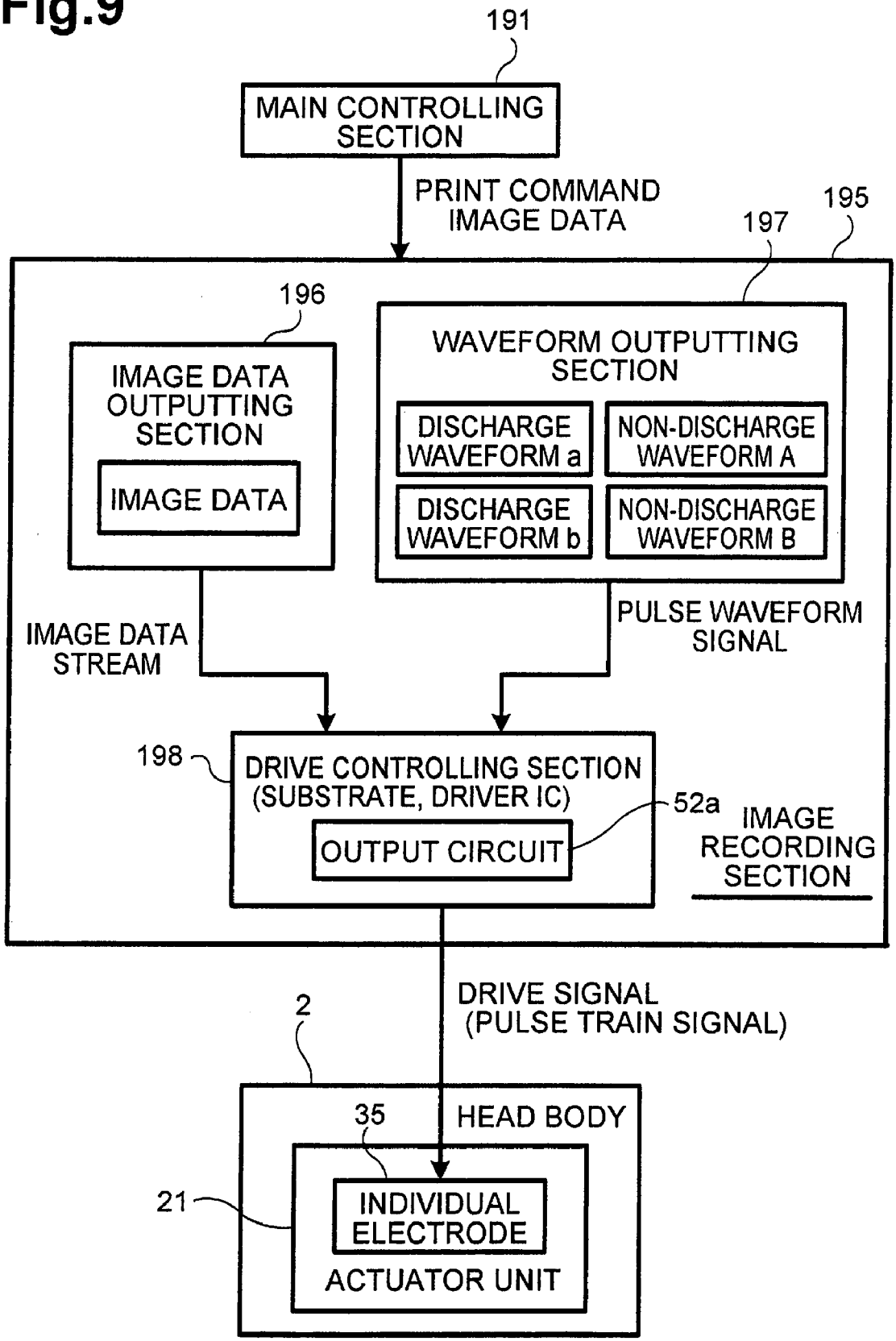
FIG. 9 is a block diagram of a detailed structure of an image recording section.

Referring to FIG. 9, it may be the image recording section 195 that generates drive signals that are supplied to each actuator unit 21. The image recording section 195 may include an image data outputting section 196, a waveform outputting section 197, and a drive controlling section 198. The drive controlling section 198 may be configured of the substrate 54, the driver IC 52 and the rest.

The image data outputting section 196 may include a storage unit, such as random access memory (RAM), that temporarily stores image data from the main controlling section 191. In such image data, items of pixel data corresponding to an image to be printed may be arranged in a predetermined order. The image data outputting section 196 may take out the items of pixel data in a predetermined order from where the items of pixel data are stored, and may output the items of pixel data to the drive controlling section 198 in order. Therefore, an image data stream, in which the items of pixel data from the image data outputting section 196 are provided consecutively, may be output in a predetermined order to the drive controlling section 198.

The waveform outputting section 197 may include a storage unit, such as read only memory (ROM), in which unit waveforms of signals that are supplied to the individual electrodes 135 are stored. The waveform outputting section 197 may store various types of unit waveforms, and may output pulse waveform signals corresponding to these unit waveforms to the drive controlling section 198. In the embodiment, discharge waveforms a and b may be provided as the unit waveforms for applying discharge energy to ink, and non-discharge waveforms A and B may be provided as unit waveforms for applying non-discharge energy to the ink.

Figure 10:
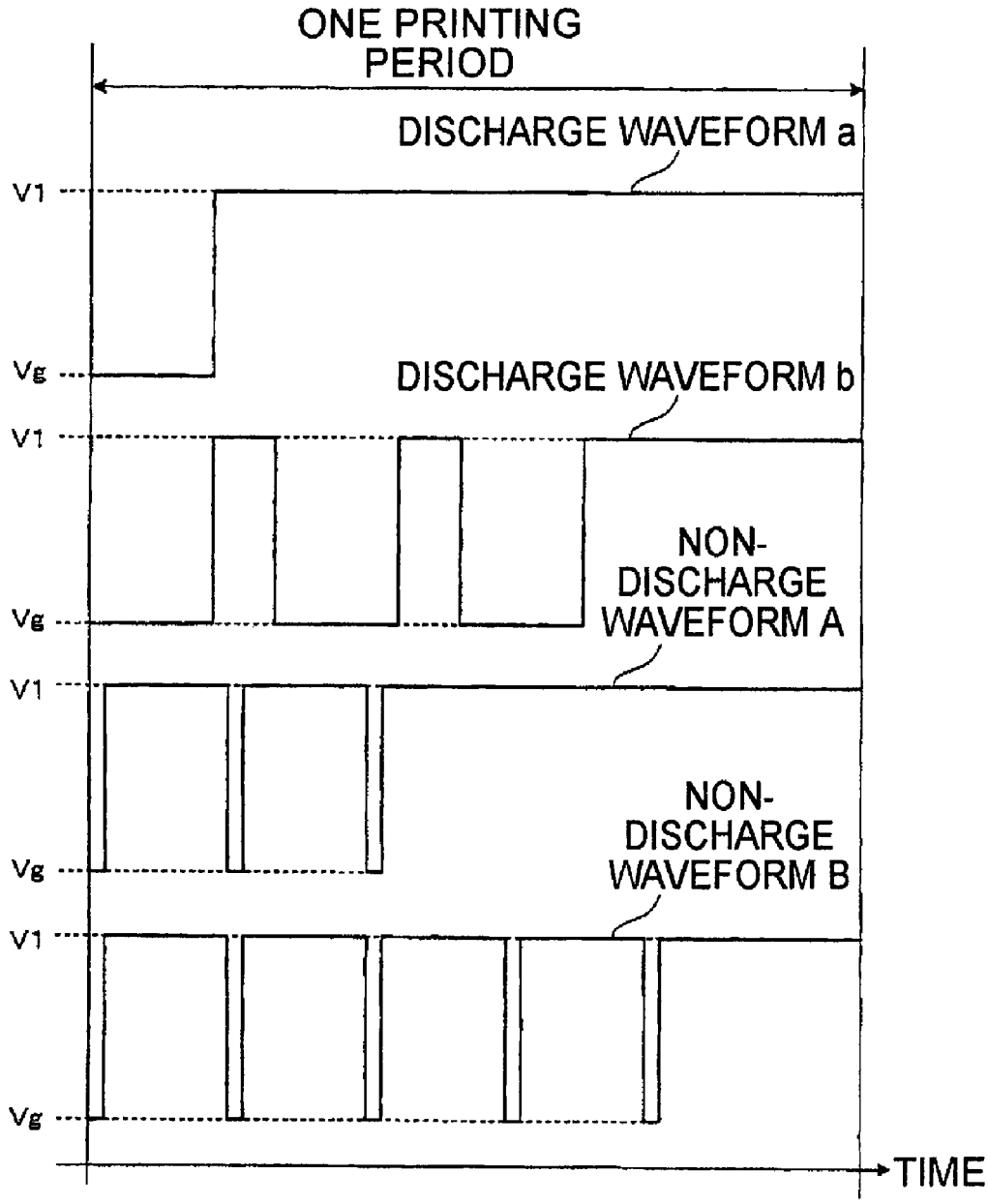
FIG. 10 is a schematic view of pulse waveforms that are supplied to individual electrodes.

Referring to FIG. 10, the unit waveforms may have the same temporal length, which is equal to one printing period. On printing period may be equivalent to a time that passes when an image of one dot is formed on a sheet P in the sheet conveying direction in correspondence with resolution. For example, in the embodiment, it is assumed that one printing period may equal 50 microseconds. Each unit waveform may include one or a plurality of pulse waveforms. The discharge waveforms a and b, i.e., first pulse signals, may include one and three rectangular pulse waveforms, respectively. The non-discharge waveforms A and B, i.e., second pulse signals, may include three and five rectangular pulse waveforms, respectively. The pulses of each discharge waveform may be disposed at equal intervals. When the pulses are supplied to the individual electrodes 135, the electrical potentials of the individual electrodes 135 may be displaced between a driving electrical potential V1 and a ground electrical potential Vg with respect to the common electrode 134. In each pulse, the higher electrical potential may correspond to the driving electrical potential V1, and the lower electrical potential may correspond to the ground electrical potential Vg. The widths of the pulses of the discharge waveforms a and b may be adjusted so that, when the pulse waveform signals are supplied to the individual electrodes 135, ink from the nozzles 108 corresponding to the individual electrodes 135 may be discharged. The widths of the pulses of the non-discharge waveforms A and B may be smaller than the widths of the pulses of the discharge waveforms a and b, and may be adjusted so that ink is not discharged from the nozzles 108.

On the basis of the image data stream from the image data outputting section 196, the drive controlling section 198 may supply in order the pulse waveform signals, corresponding to either one of the discharge waveforms a and b from the waveform outputting section 197, to the actuator units 21. More specifically, the waveform signals may be supplied as follows. The items of pixel data may be provided consecutively in a predetermined order in the image data stream from the image data outputting section 196. The drive controlling section 198 may select the discharge waveform corresponding to each item of pixel data from the discharge waveforms a and b. Then, the drive controlling section 198 may supply at a predetermined timing the pulse waveform signals corresponding to the selected waveform from the output circuit 52*a* to the individual electrodes 135 corresponding to the items of pixel data. This may cause a pulse train signal, in which the pulse waveforms are consecutively provided, from the drive controlling section 198 to the individual electrodes 135.

When the pulse train signal corresponding to either the discharge waveform a or the discharge waveform b is supplied from the drive controlling section 198 to the individual electrodes 135, the actuator units 21 may operate as follows. First, when neither of the waveforms is supplied, the electrical potentials of the individual electrodes 135 with respect to the common electrode 134 may be maintained at the driving electrical potential V1. This may cause areas corresponding to the individual electrodes 135 at the actuator units 21 to be deformed into a convex shape towards the pressure chambers 110, thereby reducing the volumes of the pressure chambers 110. Then, each time one pulse waveform may be supplied to the individual electrodes 135 from the drive controlling section 198, the electrical potentials of the individual electrodes 135 may temporarily become the ground electrical potential Vg. After the passage of a period of time corresponding to the pulse width of the pulse waveforms, the electrical potentials of the individual electrodes 135 may return again to the driving electrical potential V1. In this case, at a timing in which the electrical potentials of the individual electrodes 135 become the ground electrical potential Vg, the pressure of the ink in the pressure chambers 110 may be reduced (that is, the volumes of the pressure chambers 110 may be increased), so that the ink is sucked into the individual ink flow paths 132 from the sub-manifold flow paths 105*a*. Thereafter, at a timing in which the electrical potentials of the individual electrodes 135 become the driving electrical potential V1 again, the pressure of the ink in the pressure chambers 110 may be increased (that is, the volumes of the pressure chambers 110 may be reduced), so that ink drops are discharged from the nozzles 108. Accordingly, supplying one pulse waveform to the individual electrodes 135 may be equivalent to supplying discharge energy to the ink in the pressure chambers 110 once.

Therefore, when the pulse waveform signal corresponding to the discharge waveform a is supplied to the individual electrodes 135, one ink drop corresponding to the one pulse waveform may be discharged from the nozzles 108 corresponding to the individual electrodes 135. In contrast, when the pulse waveform signal corresponding to the discharge waveform b is supplied to the individual electrodes 135, a plurality of, e.g., three, ink drops corresponding to the three pulse waveforms may be discharged from the nozzles 108 corresponding to the individual electrodes 135. The ink drop discharged from the nozzles 108 on the basis of one discharge waveform, i.e., one unit waveform, may land on a sheet P so as to form one dot. Therefore, the dot formed on the basis of the discharge waveform b may be formed using more ink than the dot formed on the basis of the discharge waveform a. That is, the discharge waveform b may be used when a dot than is darker than that formed on the basis of the discharge waveform a is formed. Accordingly, the discharge waveform a or the discharge waveform b corresponding to each item of pixel data may be properly supplied to each individual electrode 135, so that each dot corresponding to its corresponding item of pixel data may be formed on the sheet P, thereby forming an image corresponding to the image data on the sheet P.

During a period in which neither the discharge waveform a nor the discharge waveform b is supplied, the drive controlling section 198 may supply the pulse waveform signals corresponding either the non-discharge waveform A or the non-discharge waveform B to the individual electrodes 135. When the pulse waveform signals corresponding to the non-discharge waveforms A and B are supplied to the individual electrodes 135, similarly to the above, the actuator units 21 may be driven with each pulse. Supplying one pulse waveform to the individual electrodes 135 may be equivalent to supplying non-discharge energy to ink in the pressure chambers 110 once. Therefore, for example, when the non-discharge waveform A is supplied to each individual electrode 135, non-discharge energy may be supplied to the ink in each pressure chamber 110 a plurality of, e.g., three, times. However, the pulse width of the non-discharge waveform may be adjusted so that the ink is not discharged from the nozzles 108 corresponding to the individual electrodes 135. Therefore, although the ink is not discharged from the nozzles 108 even if the waveform signals corresponding to the non-discharge waveforms A and B are supplied to the individual electrodes 135, a meniscus of the ink near the openings of the nozzles 108 may be vibrated very slightly.

During a period in which an image is not formed on a sheet P, when the openings of the nozzles 108 are opened to the atmosphere, ink near the openings may be dried. When the viscosity of the ink is increased as the drying of the ink progresses, discharge characteristics of the ink from the nozzles 108 may change. This may reduce image quality of the image formed on the sheet P. Accordingly, during the period in which the image is not formed on the sheet P, the drive controlling section 198 may supply the pulse train signal, in which the waveform signals corresponding to the non-discharge waveform A or the non-discharge waveform B are consecutively provided, to the individual electrodes 135. This may cause the meniscus of the ink near the openings of the nozzles 108 to vibrate very slightly, so that the drying of the ink during the period in which ink is not discharged from the nozzles 108 may be restricted. Therefore, it may restrict a reduction in image quality.

When the cap unit 150 that protects the ink discharge surfaces 2*a* is provided as in the embodiment, how easily the ink is dried at the openings of the nozzles 108 may depend upon whether or not the ink discharge surfaces 2*a* are covered with the cap unit 150. For example, during a period in which the ink discharge surfaces 2*a* are covered with the cap unit 150, the ink near the openings of the nozzles 108 may be not easily dried. However, in the embodiment, for the purpose of restricting drying of the ink, after a period in which an image is formed on a sheet P is completed, the cap unit 150 may be moved to the covering position where it covers the ink discharge surfaces 2*a*. However, when the cap unit 150 covers the ink discharge surfaces 2*a* for a long period of time, the drying of the ink near the openings may progress. This may increase the viscosity of the ink. In this case, if this state continues, ink may not be properly discharged from the nozzles 108.

Accordingly, prior to starting recording of an image, it may be necessary to reduce the viscosity of the ink by supplying the non-discharge waveform A or B to the individual electrodes 135 and slightly vibrating the ink. Here, for quickly reducing the viscosity of the ink, it may be necessary to quickly supply a large number of pulses to the individual electrodes 135. Therefore, prior to starting the recording of the image, a waveform signal including a large number of pulses may be continuously supplied to the individual electrodes 135.

However, when a waveform signal including a large number of pulses is supplied, the viscosity of the ink may be sufficiently reduced prior to starting the recording of the image. Therefore, continuously supplying a large number of pulses in this case may result in wastefully consuming energy. Accordingly, the supply of a pulse waveform signal may be completed stopped after supplying a plurality of pulses. However, the openings of the nozzles 108 may be opened to the atmosphere when the cap unit 150 separates from the ink discharge surfaces 2*a*, causing the drying of the ink to progress quickly. Therefore, when the ink completely stops vibrating very slightly, the viscosity of the ink may increase again until printing is started.

Figure 11:
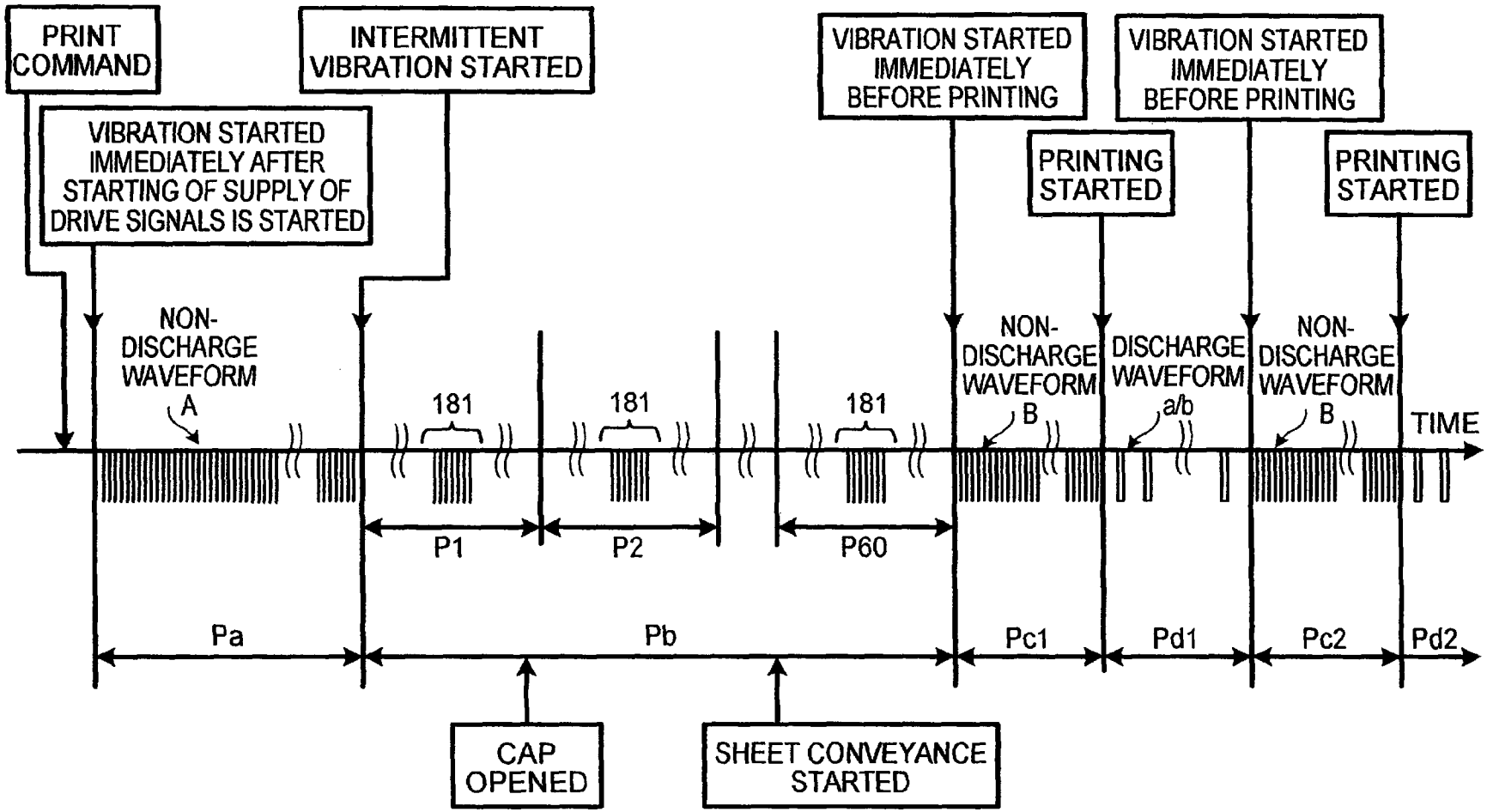
FIG. 11 is a schematic view of drive signals that a drive controlling section supplies to the individual electrodes prior to starting printing.

Accordingly, the drive controlling section 198 according to the embodiment may be configured so that drive signals are supplied to the individual electrodes 135 as follows. Referring to FIG. 11, when a print command is transmitted from the main controlling section 191, the drive controlling section 198 may supply the drive signals to the certain individual electrodes 135, so that the ink starts to vibration for agitation. Then, during a period Pa immediately after the supply of the drive signals is started, the non-discharge waveform A, i.e., corresponding to when the number n of the pulse waveform signals is 3, may be continuously supplied to the certain individual electrodes 135. Since the plurality of, e.g., three, pulse waveforms are disposed at equal intervals in the non-discharge waveform A, the non-discharge waveform A may be continuously supplied, so that the plurality of pulse waveforms, disposed at equal intervals, may be supplied to the certain individual electrodes 135 at a predetermined time interval. This may cause to quickly reduce the viscosity of the ink whose viscosity is high immediately after opening the cap unit 150.

When the period Pa is completed, in a period Pb, the non-discharge waveform A may be intermittently supplied to the certain individual electrodes 135. This may intermittently vibrate the ink near the openings of the nozzles 108. More specifically, during each of periods P1 to P60 of the period Pb, a waveform signal 181 may be supplied to the certain individual electrodes 135 only once. The waveform signals 181 may be pulse train signals in which a predetermined number of non-discharge waveforms A are consecutively provided. Therefore, supplying the waveform signals 181 may cause supplying three pulse waveforms, disposed at equal intervals, to the certain individual electrodes 135 at a predetermined time interval. When the waveform signals 181 are not supplied, the plurality of, e.g., two, types of discharge waveforms may be not supplied, to maintain the electrical potentials of the certain individual electrodes 135 to the driving electrical potential V1. Therefore, the non-discharge waveform A may be intermittently supplied to the certain individual electrodes 135. The cap unit 150 may be opened at one of the timings in the period Pb. That is, the cap unit 150 may be moved from the covering position to the open position. The sheet conveying mechanism 40 may start conveying a sheet P.

When the period Pb is completed, in a period Pc1, the non-discharge waveform B, i.e., corresponding to when the number m of the pulse waveform signals is 5, may be continuously supplied to the individual electrodes 135. The period Pc1 may correspond to a period from a time immediately before starting printing to a time when the printing is started. Since the plurality of, e.g., five, pulse waveforms are disposed at equal intervals in the non-discharge waveform B, the non-discharge waveform B may be continuously supplied, so that the plurality of, e.g., five, pulse waveforms, disposed at equal intervals, can be supplied to the individual electrodes 135 at a predetermined time interval. When the period Pc1 ends, the printing may be started. In a period Pd1, an image may be formed on a first sheet P. When the period Pd1 ends, in a period Pc2, the non-discharge waveform may be continuously supplied to the individual electrodes 135. Then, when the period Pc2 ends, in a period Pd2, an image may be formed on a second sheet P. Accordingly, each time printing on one sheet P is completed, the non-discharge waveform B may be continuously supplied to the individual electrodes 135 prior to starting printing on a next sheet P.

Figure 12:
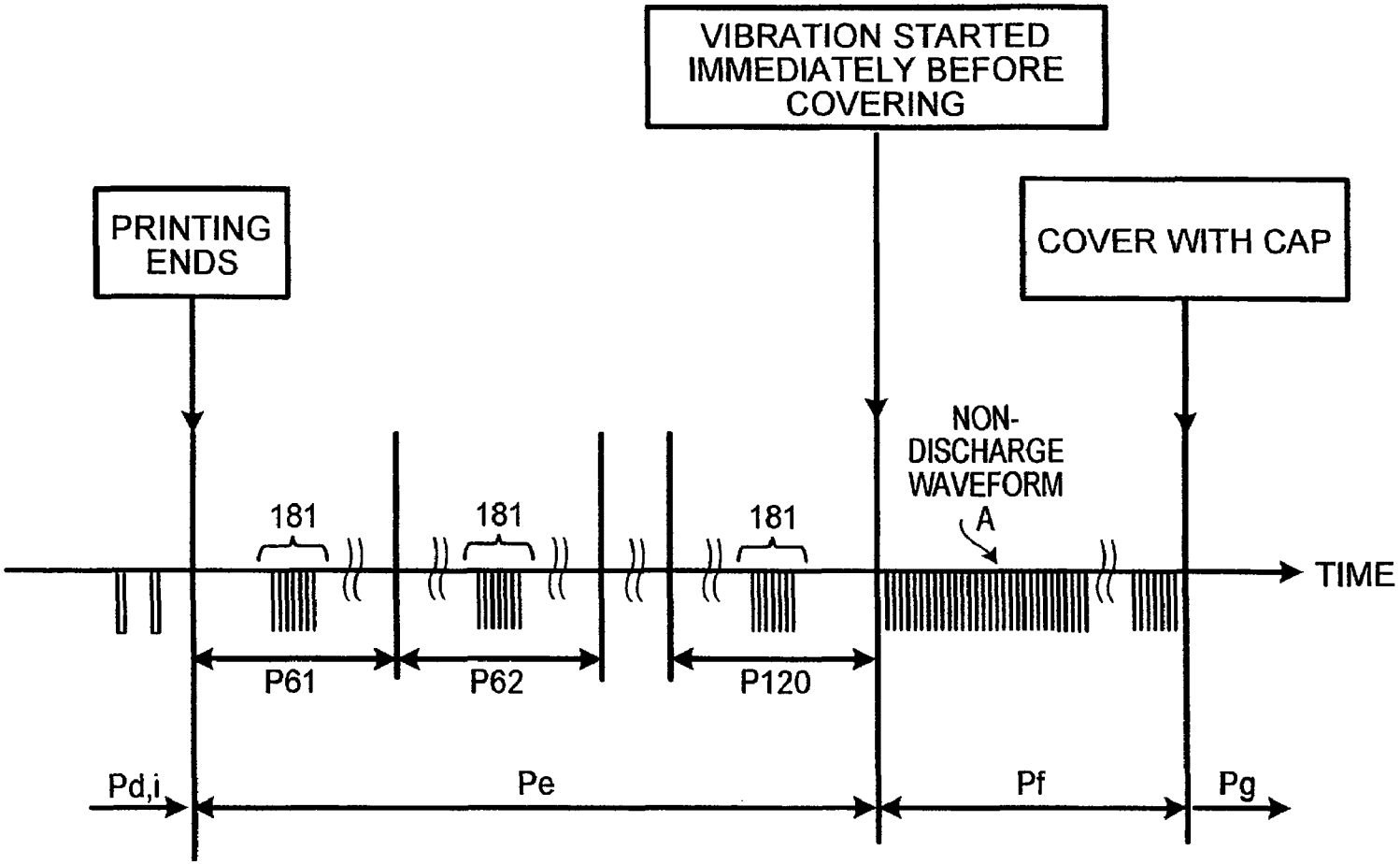
FIG. 12 is a schematic view of drive signals that the drive controlling section supplies to the individual electrodes after the printing is completed.

Referring to FIG. 12, when formation of an image on sheets P of up to an ith sheet P is completed, in a period Pe, the non-discharge waveform A may be intermittently supplied to the individual electrodes 135. i is a natural number greater than or equal to 2. More specifically, waveform signals 181 that are the same as those in the period Pb may be supplied so that one waveform signal 181 is supplied once in each of periods P61 to P120 of the period Pb. When the period Pe ends, in a period Pf, the non-discharge waveform A may be continuously supplied to the individual electrodes 135. The period Pf may correspond to a period from slightly before the ink discharge surfaces 2*a* are covered with the cap unit 150 to when the ink discharge surfaces 2*a* are covered with the cap unit 150. A period Pg may correspond to a period during which the ink discharge surfaces 2*a* are covered with the cap unit 150.

Table 1 shows an example of, the number of pulses supplied to the individual electrodes 135 and the length of each period shown in FIGS. 11 and 12. In Table 1, the "length" column indicates a temporal length in each period. The "total-number-of-unit-waveform" column indicates the total number of unit waveforms supplied to one individual electrode 135 in each period. For example, in the period Pc1, 1000 non-discharge waveforms B are supplied to the individual electrode 135. The "number-of-pulses/waveform" column indicates the number of pulses included in one waveform. For example, in the period Pc1, the waveforms that are supplied to the individual electrode 135 are the non-discharge waveforms B. Therefore, this "5/waveform B" indicates that, in the period Pc1, one non-discharge waveform B that is supplied includes five pulses. The "number-of-pulses/millisecond" column indicates the average number of pulses per millisecond in each period. For example, in the period Pc1, in 50 milliseconds, 1000 non-discharge waveforms B, each including five pulses, are supplied. Therefore, the average number of pulses per one millisecond is 100.

TABLE 1

| | | LENGTH (MILLISECONDS) | TOTAL NUMBER OF UNIT WAVEFORMS | NUMBER OF PULSES/WAVEFORM | NUMBER OF PULSES/MILLISECOND |
|---|---|---|---|---|---|
| Pa | VIBRATION PERIOD FROM IMMEDIATELY AFTER SUPPLY OF DRIVE SIGNALS IS STARTED | 100 | 2000 | 3/WAVEFORM A | 60 |
| Pb | INTERMITTENT VIBRATION PERIOD | 60000 | 12000 | 3/WAVEFORM A | 0.6 |
| P1~P120 | 1st~120th ONE SECOND PERIOD | 1000 EACH | 200 EACH | 3/WAVEFORM A | 0.6 |
| Pc1~Pc,i | VIBRATION PERIOD IMMEDIATELY BEFORE DISCHARGE | 50 EACH | 1000 EACH | 5/WAVEFORM B | 100 |
| Pd1~Pd,i | 1st~ith PAGE PRINTING PERIOD | — | — | — | — |
| Pd | INTERMITTENT VIBRATION PERIOD | 1000 × (m − 60) | 200 × (m − 60) | 3/WAVEFORM A | 0.6 |
| Pf | VIBRATION PERIOD IMMEDIATELY BEFORE COVERING | 100 | 2000 | 3/WAVEFORM A | 60 |

As shown in Table 1, in the vibration period Pa from immediately after the supply of the drive signals is started, the non-discharge waveforms A are continuously supplied, so that 60 pulses/millisecond may be continuously supplied to the individual electrode 135 for 100 milliseconds. That is, the average number of pulses supplied to the individual electrode 135 may be greater than in a period equal to the sum of the intermittent vibration period Pb and the vibration period Pc1. Therefore, even if the viscosity of the ink is increased while the cap unit 150 is kept at the covering position for a long period of time, the viscosity of the ink may be quickly reduced.

In the intermittent vibration period Pb after the vibration period Pa, the waveform signals 181 comprising 200 non-discharge waveforms A may be supplied within each of the periods P1 to P60. This may cause 0.6 pulses per one millisecond to be supplied over 60000 milliseconds, i.e., one minute. Therefore, ink drying that tends to progress due to the opening of the cap unit 150 may be restricted while restricting consumption of electrical power.

In the vibration period Pc1 immediately before starting printing, the non-discharge waveforms B may be continuously supplied, to continuously supply 100 pulses per one millisecond to the individual electrode 135 over 50 milliseconds. That is, the average number of pulses supplied to the individual electrode may be larger than in the intermittent vibration period Pb. Therefore, even if the viscosity of the ink is not sufficiently reduced in the vibration period Pa, or ink drying cannot be sufficiently reduced in the intermittent vibration period Pb, a large number of pulses may be supplied in a short period of time before starting printing, so that the printing can be started with the ink viscosity being reliably reduced.

In the entire total period, i.e., immediately before printing, equal to the sum of the intermittent vibration period Pb and the vibration period Pc1, the average number of pulses supplied to the individual electrode 135 per one millisecond may be 0.68. Therefore, compared to when 60 pulses per one millisecond are continuously supplied until the time before printing as in the period Pa, the viscosity of the ink may be reliably reduced by supplying a large number of pulses in a short period before starting printing, while reliably restricting energy consumption.

Even when an image is formed on a plurality of sheets P, in each of the vibration periods Pc2 to Pc, I immediately before discharging ink immediately prior to printing on the 1st to the ith page, the non-discharge waveforms B may be continuously supplied, so that the printing can be started on each sheet P while the viscosity of the ink is reliably reduced.

In the intermittent vibration period Pd after the printing of all of the sheets P is completed, as in the intermittent vibration period Pb, the non-discharge waveforms A may be intermittently supplied, so that progress of the drying of the ink can be restricted while the cap unit 150 covers the ink discharge surfaces 2*a* from after the printing is completed.

In the vibration period Pf immediately before the cap unit 150 covers the ink discharge surfaces 2*a*, the non-discharge waveforms A may be continuously supplied, so that the ink discharge surfaces 2*a* can be covered by the cap unit 150 after the viscosity of the ink is sufficiently reduced.

Although embodiments have been described in detail herein, the scope of this patent is not limited thereto. It will be appreciated by those of ordinary skill in the relevant art that various modifications may be made without departing from the scope of the invention. Accordingly, the embodiments disclosed herein are exemplary, and are not limiting. It is to be understood that the scope of the invention is to be determined by the claims which follow.

For example, according to the above-described embodiments, referring to FIG. 11, the supply of non-discharge waveforms A may be started before the cap unit 150 separates from the ink discharge surfaces 2*a*. However, the supply of non-discharge waveforms A may be started after the cap unit 150 is opened. In this case, since the period of supplying drive signals can be reduced, it is possible to restrict energy consumption.

According to the above-described embodiments, the unit waveforms including one or a plurality of pulse waveforms may be continuously or intermittently supplied to the individual electrode 35. However, the pulse waveforms may be supplied to the individual electrodes 35 without using such unit waveforms.

According to the above-described embodiments, the non-discharge waveforms A and B, which are unit waveforms, may include a plurality of pulse waveforms disposed at equal intervals. Of the pulse waveforms, the temporal interval from the last pulse to the back edge of the unit waveform may differ from the interval between the pulse waveforms. Therefore, for example, when the non-discharge waveforms A are continuously supplied to the individual electrodes 35, after three pulse waveforms are supplied at equal intervals, the next three pulse waveforms may be supplied at equal intervals subsequent to the temporal period that is longer than the equal intervals. However, a unit waveform in which, unlike the non-discharge waveforms A and B, a plurality of pulse waveforms are included at equal intervals, and all of the pulse waveforms are supplied at equal intervals when they are continuously supplied to the individual electrodes 35 may be provided.

According to the above-described embodiments, discharge energy and non-discharge energy may be supplied when the pulse waveform signals are supplied to the individual electrodes 35. However, discharge energy or non-discharge energy may be applied when signals other than pulse waveform signals are supplied to the actuators.

What is claimed is:

1. An inkjet recording apparatus that forms an image corresponding to an image data on a recording medium, the inkjet recording apparatus comprising:

a flow path unit comprising a discharge port that is configured to discharge ink and an ink flow path that is configured to supply the ink to the discharge port;

an actuator that is configured to supply discharge energy to the ink in the ink flow path to be discharged from the discharge port and non-discharge energy to the ink in the ink flow path, wherein the non-discharge energy is adjusted not to discharge the ink from the discharge port;

a drive controller that is configured to cause the actuator to supply the discharge energy to the ink to discharge the ink onto the recording medium;

a cap that is configured to move between a covering position and an open position, wherein when the cap is at the covering position, the cap covers the discharge port, and wherein when the cap is at the open position, the discharge port is uncovered; and a cap moving unit that is configured to move the cap between the open position and the covering position;

wherein, after the image data begins being supplied, the drive controller causes the actuator to supply the non-discharge energy to the ink in both a first period and a second period, wherein the first period begins at a starting of the supply of the non-discharge energy, and the second period begins at the end of the first period and ends when the supply of the discharge energy is started, wherein a frequency of the supply of the non-discharge energy during the first period is greater than the frequency of the supply of the non-discharge energy during the second period.

2. The inkjet recording apparatus according to claim 1, wherein the first period is a period immediately after starting of the supply of the non-discharge energy.

3. The inkjet recording apparatus according to claim 1, wherein the cap moving unit is configured to move the cap from the covering position to the open position when the image data begins to be supplied, and to move the cap from the open position to the covering position when the formation of the image on the recording medium is completed.

4. The inkjet recording apparatus according to claim 1, wherein the drive controller supplies a first pulse signal and a second pulse signal to the actuator, and wherein, when the first pulse signal is supplied from drive controller, the actuator supplies the discharge energy to the ink, and, when the second pulse signal is supplied from the drive controller, the actuator supplies the non-discharge energy to the ink.

5. The inkjet recording apparatus according to claim 4, wherein, within the first period, the drive controller supplies a first predetermined number of pulse waveform signals that each include a second predetermined number of the second pulse signals, to the actuator, with the second predetermined number being a natural number, and the first predetermined number and the second predetermined number are the same, and wherein, after passage of the first period, the drive controller intermittently supplies the first predetermined number of pulse waveform signals to the actuator.

6. The inkjet recording apparatus according to claim 4, wherein the actuator comprises:

an individual electrode that comprises the first and second pulse signals supplied thereto from the drive controller, a common electrode, and a piezoelectric layer that is positioned therebetween, wherein, when either of the first and second pulse signals is supplied to the individual electrode, the ink flow path is deformed to apply pressure to the ink because of deformation of the piezoelectric layer by an electrical field.

7. The inkjet recording apparatus according to claim 1, wherein the drive controller is configured to cause the actuator to supply the non-discharge energy to the ink, wherein a frequency of the supply of the non-discharge energy during an immediately prior-to-printing period within the second period is greater than the frequency of the supply of the non-discharge energy during a period prior to starting the immediately prior-to-printing period within the second period.

8. The inkjet recording apparatus according to claim 6, wherein, in an immediately prior-to-discharge period that is within the second period and that occurs immediately before the actuator is caused to start supplying the discharge energy to the ink, the drive controller is configured to temporally continuously supply a third predetermined number of pulse waveform signals to the actuator, the third predetermined number of pulse waveform signals having an fourth predetermined number of pulses arranged therein and having a same temporal length as the first predetermined number of pulse waveform signals, and the third predetermined number and the fourth predetermined number are the same, and the fourth predetermined number is a natural number that is greater than the second predetermined number.

9. The inkjet recording apparatus according to claim 1, wherein, in each of the first period and the second period, a period in which the actuator repeatedly supplies the non-discharge energy to the ink at equal time intervals is repeated with a temporal interval being interposed therebetween.

10. The inkjet recording apparatus according to claim 1, wherein from a time after the formation of the image on the recording medium to a time before the cap moving unit moves the cap to the covering position, the drive controller causes the actuator to start supplying the non-discharge energy to the ink.

11. The inkjet recording apparatus according to claim 10, wherein the drive controller is configured to cause the actuator to supply the non-discharge energy to the ink, wherein the frequency of the supply of the non-discharge energy in an immediately prior-to-covering period immediately before the cap moving unit moves the cap to the covering position is greater than the frequency of the supply of the non-discharge energy in a period from the starting of the supply of the non-discharge energy after the formation of the image on the recording medium to the immediately prior-to-covering period is started.

12. The inkjet recording apparatus according to claim 1, wherein the first period is started on or after the cap moving unit moves the cap from the covering position to the open position.

13. A method for controlling an inkjet recording apparatus, the method comprising the steps of:

supplying an image data for forming an image onto a recording medium;

supplying non-discharge energy to ink in an ink flow path in a first period, wherein the non-discharge energy is adjusted not to discharge the ink from the discharge port, and wherein the first period begins at starting of the supply of the non-discharge energy;

supplying non-discharge energy to the ink in the ink flow path in a second period, and wherein the second period begins at the end of the first period;

supplying discharge energy to the ink in the ink flow path to be discharged from a discharge port to the actuator when the second period ends, and wherein a frequency of the supply of the non-discharge energy during the first period is greater than the frequency of the supply of the non-discharge energy during the second period.

14. The method for controlling the inkjet recording apparatus according to claim 13, the method further comprising the step of:

moving a cap from a covering position to an open position during the second period, wherein when the cap is at the covering position, the cap covers the discharge port, and wherein when the cap is at the open position, the discharge port is uncovered.

15. The method for controlling the inkjet recording apparatus according to claim 14, the method further comprising the step of:

moving the cap from the open position to the covering position after the ink is discharged from the discharge port.

* * * * *